United States Patent [19]

McCombs et al.

[11] Patent Number: 5,043,542

[45] Date of Patent: Aug. 27, 1991

[54] SELF-ADJUSTING ELECTRIC SWITCH AND GAS CYLINDER

[75] Inventors: Mary J. McCombs, Grand Rapids; Gary A. Babcock, Ada; Bennett L. VanderGriend, Wyoming, all of Mich.

[73] Assignee: Suspa Incorporated, Grand Rapids, Mich.

[21] Appl. No.: 583,450

[22] Filed: Sep. 17, 1990

[51] Int. Cl.[5] ..... H01H 3/16

[52] U.S. Cl. ..... 200/61.62; 200/52 R; 200/82 D

[58] Field of Search ..... 200/52 R, 61.62, 82 D, 200/61.44; 267/64.11; 307/119

[56] References Cited

U.S. PATENT DOCUMENTS

| | | | |
|---|---|---|---|
| Re. 30,663 | 6/1981 | Schnitzius | 200/52 R |
| 3,919,509 | 11/1975 | Schnitzius | 200/61.62 |
| 4,263,488 | 4/1981 | Freitag et al. | 200/52 R |
| 4,281,884 | 8/1981 | Freitag et al. | 339/9 R |
| 4,298,194 | 11/1981 | Marx | 200/61.62 |
| 4,316,098 | 2/1982 | Freitag et al. | 307/119 |
| 4,317,014 | 2/1982 | Langanke | 200/61.62 |
| 4,400,600 | 8/1983 | Freitag et al. | 200/52 R |
| 4,667,940 | 5/1987 | Jaillet | 267/64.11 |

*Primary Examiner*—J. R. Scott

*Attorney, Agent, or Firm*—Price, Heneveld, Cooper, DeWitt & Litton

[57] ABSTRACT

A condition settable combination gas cylinder and electric switch, the switch being mounted on the extended piston rod of the cylinder. The switch has an internal retainer within the switch housing and engageable by the cylinder housing in the first compression stroke of the cylinder, to shift the retainer and two electrical contacts thereon to a set position exactly suiting the cumulative buildout tolerance of the vehicle or other machine on which the novel combination is mounted. The retainer is locked there against reverse movement when the cylinder again extends and thereby withdraws from the switch. Another electrical contact is located on a switch plunger that moves axially back and forth with the retainer and switch housing. Thus, each repeat extension by the cylinder causes interengagement of the three electrical contacts.

30 Claims, 2 Drawing Sheets

SELF-ADJUSTING ELECTRIC SWITCH AND GAS CYLINDER

BACKGROUND OF THE INVENTION

This invention relates to a gas cylinder and electrical switch combination, and particularly such a combination which sets the switch function parameter on the initial operation of the gas cylinder.

Gas cylinders are commonly used on vehicle liftgates and lift windows, some of which are referred to as hatchbacks, as well as on a variety of other items such as furniture, office machines, etc. When used on such assemblies, particularly automotive equipment, it is sometimes desirable to electrically activate a light or other device when the cylinder is operated. A good example of this is the actuation of a dome light in a vehicle when the gas cylinder is extended by opening the liftgate/lift window. It has been known heretofore to provide an electric switch mounted on the cylinder so that the switch is actuated by the cylinder with opening of the liftgate/lift window. Specifically, the affiliated German company of the assignee herein has manufactured and sold pneumatic cylinder-electrical switch combination units for use on automobiles as early as 1978. However, there has existed a problem in assuring actuation of the switch with opening of the liftgate/lift window. Conceivably, this problem could also exist on other equipment. This problem has been found to be due to the "buildout tolerance" involved. Specifically, when a vehicle is assembled from many components, each connection or subassembly has a tolerance range. When these ranges are accumulated for several connections, the total variance between components such as the liftgate/lift window and the adjacent body structure can be as much as three-eighths or even one-half inch. Hence, while the electrical switch may function effectively in some vehicles off the assembly line, it might not function properly in others because of the failure of electrical contacts to compensate for the different amounts of cylinder movement.

SUMMARY OF THE INVENTION

An object of this invention is to provide an electrical switch assembly, the components of which are set in an effective consistent position and relationship at the initial contraction of the gas cylinder with which it is combined. This sets the position of an electrical contact member to assure electrical connection with each subsequent extension of the cylinder thereafter. The gas cylinder itself sets the switch parameter, thereby accommodating the particular cumulative buildout tolerance for that specific assembly, e.g., of an automobile. The gas cylinder moves and adjusts an inwardly shiftable locking retainer which is movable into the switch housing a variable amount as necessary to assure effective switching thereafter, the retainer being locked against subsequent return movement, i.e., outward movement, in the switch housing when the cylinder is reversed, i.e., extended. The locking retainer has a body which preferably is cylindrical, fitting within a surrounding cylindrical switch housing, and movable inwardly, i.e., contractively, under axial abutment force of the contracting cylinder, but fixed, preferably locked, against reverse, i.e., outward expansion movement in the housing by a retaining ring which bites into the housing.

The switch is mounted axially on the distal end of the extended rod of the pneumatic cylinder subassembly, externally of the cylinder housing. The switch has a plunger which is compressed into the switch housing by the cylinder housing with each contraction of the pneumatic cylinder subassembly, and is biased outwardly to shift back when the cylinder subassembly is subsequently extended. The cylinder subassembly is conventional, being of known construction. Normally, the cylinder subassembly is biased to an extended condition by compressed gas, usually nitrogen, in the cylinder housing. One end of the cylinder housing is closed and has mounting means such as a ball joint for attachment to one component of the vehicle or other apparatus, while the outer end of the extended piston rod has attachment means such as a ball joint for connection to another component of the vehicle.

When the switch and cylinder are assembled together, and mounted to the vehicle, the first compressive or contractive movement of the switch with contraction of the cylinder causes the end of the cylinder housing adjacent the extended piston rod to abut the retainer body of the switch assembly, pressing it further into the surrounding housing to a then set condition at the necessary location to assure consistent switch actuation thereafter. Upon subsequent extension of the gas cylinder, the switch retainer is in this set condition, locked in position against reverse, i.e., outward, axial movement. This locking is preferably achieved by a retainer ring oriented and configurated to bite into the housing inner surface and prevent outward movement. The retainer body fits snugly in the switch housing and has a closed outer end, except for an orifice receiving the switch plunger and the piston rod. Thus, the switch contacts are protected.

These and other objects, advantages and features of the invention will be apparent to those in the art upon studying the following specification in conjunction with the drawings.

DESCRIPTION OF THE PREFERRED EMBODIMENT

Figure 1:
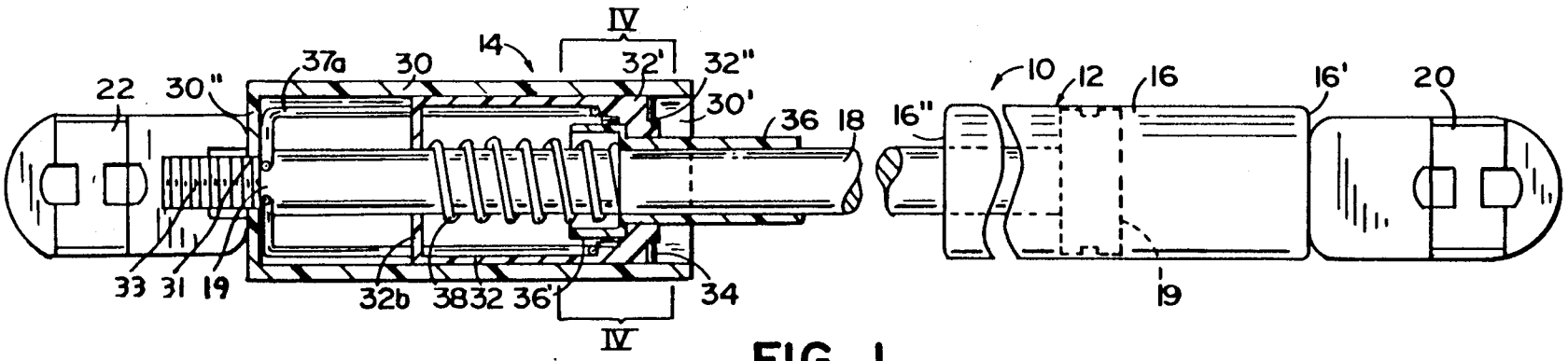
FIG. 1 is an elevational view of a pneumatic cylinder and switch combination employing the invention, the switch being shown partially sectioned and the cylinder subassembly fully extended in condition, prior to initial setting of the switch.

Referring now specifically to the drawings, the combination 10 there depicted includes a gas cylinder subassembly 12 and an electric switch subassembly 14 interconnected therewith and mounted on the cylinder components.

The gas cylinder subassembly 12 is basically of conventional construction, including an elongated, hollow, cylindrical housing 16 which is closed at one end 16' and has a second sealed annular end 16" around the extended portion of a piston rod 18. This elongated piston rod has a piston (shown schematically at 19) on its inner end, i.e., within cylinder body 16, such piston 19 and piston rod 18 normally being biased toward the extended condition by a gas, usually nitrogen, under elevated pressure within the cylinder housing 16. The rod 18 extends from end 16 in varying amounts. On the closed end of cylinder body 16' is mounting means 20, preferably a ball socket or the equivalent. On the outer distal end of piston rod 18 is attachment means 22, preferably a ball socket or the equivalent, threadably connected to the piston rod 18. This cylinder subassembly 12 has internal components which may be of selected type such as, for example, that shown in U.S. Pat. No. 4,852,862 issued Aug. 1, 1989, or U.S. Pat. No. 4,796,871 issued Jan. 10, 1989, incorporated by reference herein.

The switch subassembly 14 is mounted on the end of piston rod 18, being held in a fixed position on the rod 18 by the threaded attachment means 22 holding it against an annular shoulder 19 on the piston rod 18. The switch subassembly 14 includes an outer housing 30 generally cylindrical in configuration, having one open end 30' into which piston rod 18 projects. The rod 18 extends through this housing 30 to the opposite end 30" which has a central opening 31 to receive the threaded end 33 of piston rod 18 and fits against the annular shoulder 19 of this piston rod 18. Thus, threaded connection of attachment element 22 onto the piston rod 18 secures the switch housing 30 tightly in position. Opening 30' is preferably of slightly greater diameter than the outer periphery of pneumatic cylinder 16 to allow the annular end of this cylinder body 16 to fit within the switch housing 30, as explained hereinafter, for presetting the switch to a certain operating condition. Alternatively, the end of cylinder 16 could be provided with an axial projection (not shown) to extend into housing 30 and engage retainer body 32. Housing 30 is of an electrically nonconductive material, preferably polymeric material such as a generally rigid plastic, e.g., nylon, polymethyl methacrylate, or similar material. Positioned within the inner diameter of housing 30 is a retaining means which preferably comprises the cylindrical retainer body 32 which fits annularly around piston rod 18. Retainer body 32 is of an electrically nonconductive material such as a generally rigid polymer or plastic, e.g., nylon, polyvinylchloride or the equivalent. It is in close fit contact with the inner diameter of housing 30. At the one axial end of body 32 oriented toward the gas cylinder subassembly 12, the retainer body is closed by a thicker end portion 32' which includes a smaller diameter outer annular shoulder 32". Fitted and retained securely on this annular shoulder 32" is a metal retaining ring 34 having radially outwardly extending sharp teeth 35 oriented at an acute angle diagonally outwardly of housing 30, enabling retainer body 32 to be axially pressed into switch housing 30 but preventing return outward movement of the retainer body 32 in a reverse direction because any axially outward force on the retainer ring 34 toward cylinder subassembly 12 causes its outer teeth 35 to bite into the inner diameter portion of housing 30. The retainer ring 34 thus serves as a holding means, and more specifically a locking means, for the retainer body 32, against return axial movement in the switch housing 30. End 32' of retainer body 32 has a circular opening in the center thereof to fit closely around rod 18 and cylindrical plunger 36 which itself is around rod 18.

Figure 2:
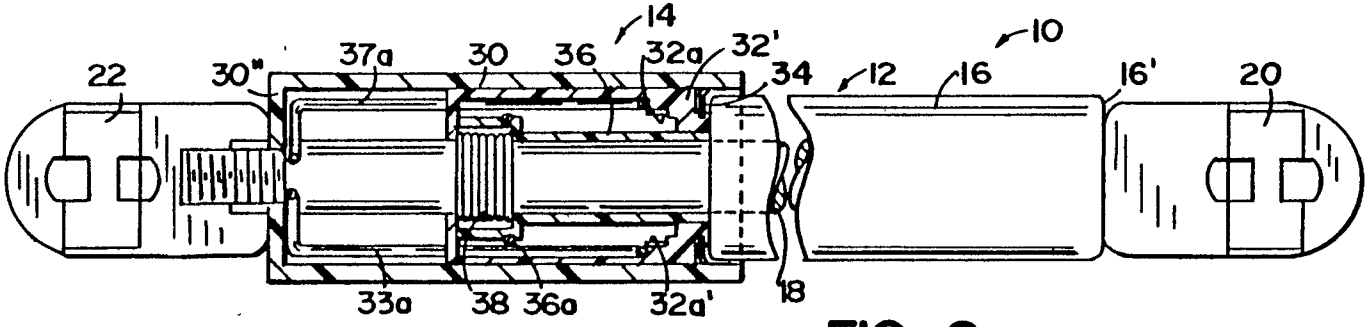
FIG. 2 is an elevational, partially sectioned view of the components in FIG. 1 with the cylinder subassembly being compressed to the extent that the cylinder has just made initial abutment with the retainer.

Received within the circular outer end of retainer body 32 is the cylindrical body of a switch plunger 36. Integral with this switch plunger 36 is a larger diameter cylindrical end portion 36' which carries an electrically conductive contact ring **36*a* (FIG. 2). This contact ring 36*a* is for engagement with cooperative electrical contacts 32*a* and 32*a'* on retainer body 32 when the switch plunger 36 is in the fully extended position, i.e., toward cylinder subassembly 12, and projecting from housing 30. When ring 36*a* engages these two contacts 32*a* and 32*a'*, it completes an electrical circuit. The switch plunger 36 is biased toward this projected position by a compression helical spring 38 around rod 18 and axially captured between switch plunger 36 and the inner end 32*b* of retainer body 32. The cylindrical opening of retainer body 32 serves as a bearing for switch plunger 36 to allow axial movement of the plunger 36 back and forth within this opening alternatively against the bias and with the bias of spring 38. This movement of switch plunger 36 causes the electrical contact ring 36*a* to break or make contacting engagement with the two contacts 32*a* and 32*a'*, the contacts making engagement when plunger 36 is biased to its extended position by spring 38, and breaking engagement when plunger 36 is moved inwardly at least a small amount against the bias of spring 38**.

Electrical leads **33*a* and 37*a* extend from contacts 32*a* and 32*a'*** respectively, to the electrical source and to the item, e.g., a dome lamp, to be energized.

Figure 3:
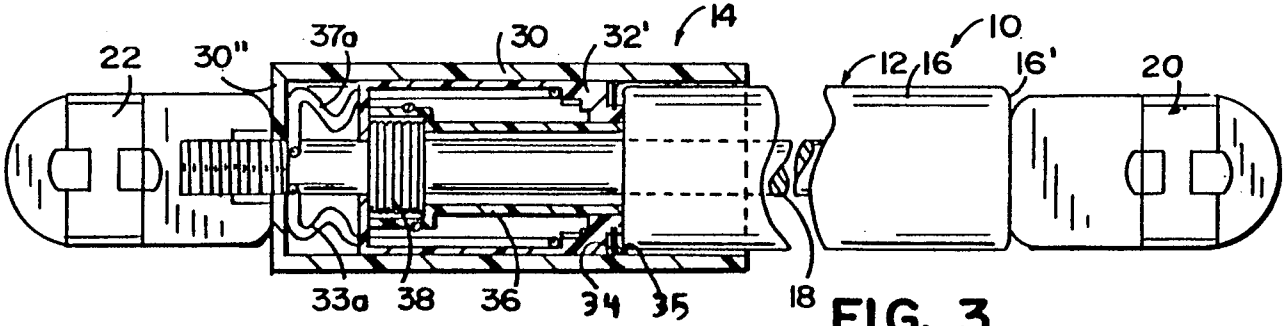
FIG. 3 is an elevational, partially sectioned view of the components in FIGS. 1 and 2 showing the cylinder subassembly contrasted to an extreme position to shift the switch retainer fully inwardly to a setting condition of the retainer.
Figure 4:
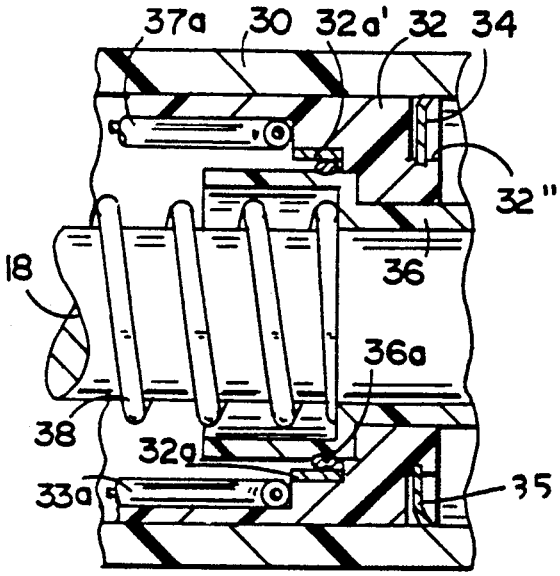
FIG. 4 is a fragmentary enlarged view of a portion of FIG. 3.

The apparatus is designed such that the switch subassembly 14 will be initially set during the first compressive stroke of cylinder subassembly 12. More specifically, this occurs after the cylinder 16 is mounted in the final assembly, e.g., an automobile, in which it is to be used, one end, for example connector 20, being attached to the vehicle body or liftgate/lift window, and the other end attachment means 22 being attached to the alternate of the liftgate/lift window and vehicle body. Due to the buildout tolerance of the particular vehicle involved, compression of the cylinder and switch assembly 10 will move the components to different axial positions from one vehicle to the next. The switch subassembly 14 is thus purposely constructed to initially be close to its fully extended condition shown at FIG. 1. When cylinder subassembly 12 is compressed in the first closing stroke, end 16" of housing 16 moves into open end 30' of switch housing 30 and engages the axially outward end 32' of switch retainer body 32 (FIG. 2), pushing it to a set position typically somewhere between the almost fully expanded switch condition shown in FIG. 1 and the fully contracted switch condition in FIG. 3. Contraction of cylinder subassembly 12 shifts the piston 19 and piston rod 18 further into cylinder 16 until end 16" of cylinder 16 first engages the outer axial end of switch plunger 36 (FIG. 2), shifting this plunger 36 axially inwardly of switch housing 30 and retainer body 32 against the bias of compression coil spring 38. When the switch plunger 36 is fully shifted into its retainer body 32 as depicted in FIG. 2., axial end 16" of cylinder 16 then engages the outer axial end 32' of retainer body 32. Further contraction of the cylinder 16 forces the entire retainer body 32 inwardly, usually somewhere between the outermost position shown in FIG. 2 and the innermost position shown in FIG. 3. This shifting force overcomes the friction of the retainer fit in the housing 30 and the force of the diagonal retainer ring teeth 35 against the housing 30. This particular switch and cylinder arrangement 10 enables the switch 14 to be custom shifted to the particular vehicle buildout tolerance encountered.

Thereafter, when the cylinder body 16 retracts, as with opening of the liftgate/lift window, the switch plunger 36 will reverse its position under the bias of compressed spring 38, but the retainer 32 will not move in reverse. Rather it will maintain its set condition, thus assuring electrical contact only at the end of subsequent expansion strokes of the cylinder subassembly 12.

Figure 5:
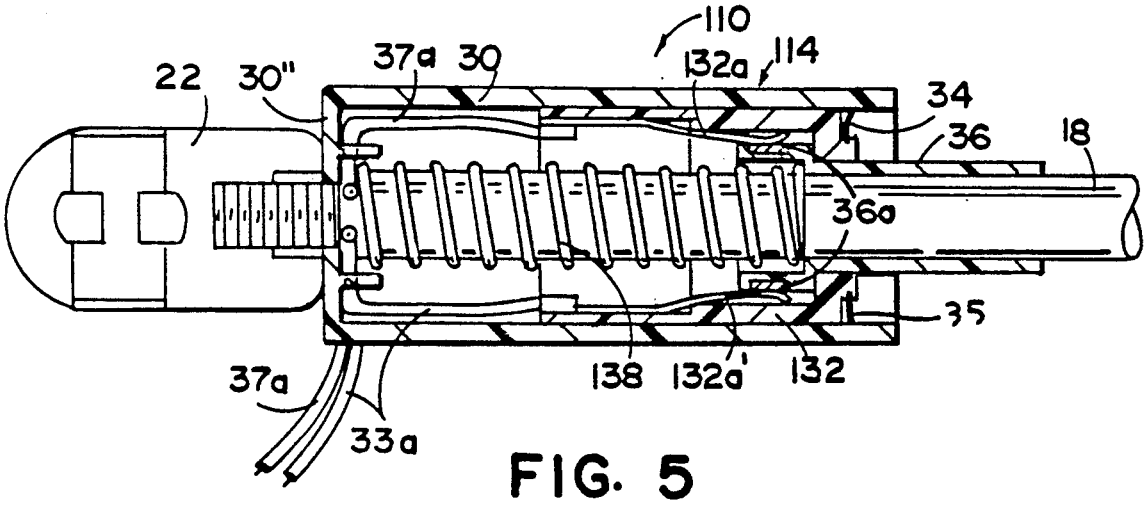
FIG. 5 is an enlarged sectional view of a second embodiment of the switch and a portion of the piston rod.
Figure 6:
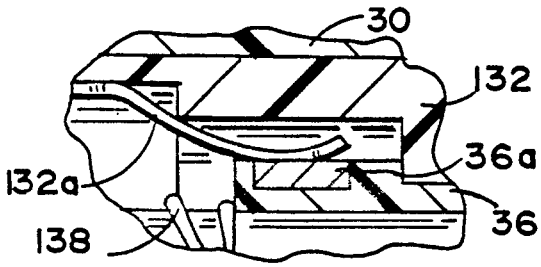
FIG. 6 is a fragmentary, enlarged view of a portion of FIG. 5.

In FIGS. 5 and 6 is disclosed an alternative assembly 110 with a modified switch subassembly 114. Like parts of the two modifications are designated by like numerals. Switch housing 30 surrounds switch retainer 132 which fits closely therewithin. Piston rod 18 of the gas cylinder subassembly 12 extends centrally through the switch. The switch housing 30 is fixedly attached to the end of rod 18 adjacent the distal end of the rod and attachment means 22. Around rod 18 is cylindrical switch plunger 36 which can move axially within the round orifice in the center of retainer 132. Around plunger 36 is an electrical contact ring 36*a*, here shown in the form of a cylindrical ring 36*a*, to make sliding contact with a pair of resilient bifurcated electrical contacts 132*a* and 132*a'* of known type, preferably of phosphor bronze, with or without a silver cladding on the free end surfaces engaging the contact ring 36*a*. These contacts 132*a* and 132*a'* are mounted on one end thereof to the inner diameter of retainer 132. The contacts are connected to lead wires 37*a* and 33*a*. Thus, engagement of ring 36*a* with the contacts 132*a* and 132*a'* completes a circuit to energize a light or other item, as desired. Compression coil spring 138 is positioned around rod 18 and extends between plunger 36 and the closed end 30" of housing 30. It biases the switch subassembly 114 toward the extended condition.

Operation of this second version is comparable to that of the first embodiment. That is, the axial position of retainer 132 is achieved with the first contraction of the cylinder subassembly 114, with the cylinder 16 pressing retainer 132 axially inwardly of housing 30 a specific amount depending on the buildout tolerance of the components to which the assembly is mounted. The teeth 35 of retaining ring 34 lock the retainer 34 against reverse movement.

Conceivably, certain details of this novel assembly could be modified to suit particular installations. It is intended that the invention is not necessarily to be limited to the preferred embodiments set forth as exemplary of the invention, but only by the scope of the appended claims and the reasonably equivalent structures to those defined therein.

The embodiments of the invention in which an exclusive property or privilege is claimed are defined as follows.

1. A condition settable combination gas cylinder and electric switch assembly comprising:

an elongated gas cylinder subassembly having a cylinder housing with one closed end and mounting means on said one end for mounting said cylinder to a device;

an internal, axially movable piston in said cylinder housing, and a piston rod extending from said piston through the second end of said cylinder housing and having an attachment means on the outer end of said rod for attachment to a second device;

said piston and piston rod being axially movable between a contracted condition and an extended condition relative to said cylinder housing;

an axially compressible and extensible electric switch subassembly around said piston rod externally of said cylinder housing, and retained on said piston rod at said attachment means;

said switch subassembly comprising an outer switch housing, an inner plunger around said piston rod and shiftable in said switch housing, and retainer means between said plunger and said switch housing for retaining electrical contact means on said retainer means in a specific location in said switch housing;

biasing means for biasing said plunger toward an extended condition with respect to said switch housing and said retainer means;

first electrical contact means on said plunger and second electrical contact means on said retainer means for completing an electrical circuit when said first and second contact means are engaged;

said retainer means being initially shiftable by said cylinder housing inwardly with respect to said switch housing to thereby enable said second electrical contact means on said retainer means to be shifted to a set position by the initial on of said cylinder subassembly;

holding means at said retainer means for holding said retainer means in said switch housing against return movement outwardly with respect to said switch housing, whereby the initial contraction of said cylinder housing and piston rod results in controlled inward movement of said retainer means in said housing by said cylinder housing to cause setting of said retainer means and said second contact means thereon at a specific location in said switch housing for subsequent switch operation relative to contraction and extension of said gas cylinder.

2. The combination in claim 1 wherein said holding means comprises locking means for locking said retainer means against return movement.

3. The gas cylinder and switch assembly in claim 1 wherein said holding means comprises a retaining ring having means for lockingly engaging said switch housing.

4. The gas cylinder and switch assembly in claim 3 wherein said engaging means comprise teeth.

5. The gas cylinder and switch assembly in claim 4 wherein said teeth are diagonally arranged to bite into said housing, and said housing has a material allowing said teeth to bite into it.

6. The gas cylinder and switch assembly in claim 5 wherein said teeth are oriented at an angle toward said cylinder subassembly to allow said inward movement and prevent outward movement.

7. The gas cylinder and switch assembly in claim 1 wherein said retainer means includes a retainer body in close fit in said switch housing, and said holding means comprises a locking retainer ring engaged between said retainer body and said switch housing.

8. The gas cylinder and switch assembly in claim 7 wherein said retainer ring has peripheral teeth oriented to allow said inward movement and to prevent return outward movement by engaging said switch housing.

9. The gas cylinder and switch assembly in claim 7 wherein said biasing means comprises a spring between said plunger and said retainer body.

10. The gas cylinder and switch assembly in claim 8 wherein said switch housing has an open end and an inner diameter for receipt of said retainer body, said open end and inner diameter being larger than the diameter of said cylinder housing second end to enable said second end to move said retainer body in said switch housing.

11. The gas cylinder and switch assembly in claim 10 wherein said switch housing is of nonconductive polymeric material, said retainer body is of nonconductive polymeric material, and said plunger is of nonconductive polymeric material, said retainer ring being locked on said retainer body; and electrical leads extending from said first and second electrical contacts.

12. A condition settable electrical switch for attachment to the extended piston rod of a gas cylinder, comprising:

an outer switch housing having an axial cavity and an open end;

settable retainer means in said switch housing cavity for retaining first electrical contact means in a specific axial location in said switch housing;

a plunger in said switch housing cavity, movable in said housing in either of two axial directions;

biasing means in said switch housing, operable for biasing said plunger in one axial direction toward said open said plunger being shiftable in the second axial direction away from said open end by a gas cylinder at said open end;

first electrical contact means on said plunger for conducting an electrical current;

second electrical contact means on said retainer for conducting electrical current;

said first and second electrical contact means being interengageable with relative movement of said plunger with said retainer means;

said retainer means being axially shiftable inwardly of said switch housing to set said second electrical contact means in a selected location within said switch housing, said retainer means having holding means for holding said retainer means in the set location against return movement toward said open end.

13. The switch in claim 12 wherein said holding means comprises locking means.

14. The switch in claim 13 wherein said locking means comprises a retaining ring having means for lockingly engaging said switch housing.

15. The switch in claim 14 wherein said engaging means comprises teeth.

16. The switch in claim 15 wherein said teeth are arranged to bite into said housing, and said housing has a material allowing said teeth to bite into it.

17. The switch in claim 16 wherein said teeth are oriented at an angle allowing said inward movement and outward movement.

18. The switch in claim 13 wherein said retainer means includes a retainer body with a close fit into said switch housing, and said locking means comprises a retainer ring engaged between said retainer body and said switch housing 19. The switch in claim 18 wherein said retainer ring has peripheral teeth oriented to allow said inward movement and to prevent return outward movement by engaging said switch housing.

20. The switch in claim 18 wherein said biasing means comprises a compression spring between said plunger and said retainer body.

21. The switch in claim 20 wherein said switch housing is of nonconductive polymeric material, said retainer body is of nonconductive polymeric material, and said plunger is of nonconductive polymeric material, said retainer ring being locked on said retainer body; and electrical leads extending from the second electrical contact means.

22. A condition settable electrical switch comprising:

a cylinder outer switch housing having an axial cavity;

cylindrical settable retainer means in said switch housing cavity for retaining first electrical contact means in a specific axial location in said switch housing;

a plunger in said switch housing cavity, movable in said housing in either of two axial directions;

said plunger being shiftable in said switch housing;

first electrical contact means on said plunger for conducting an electrical current;

second electrical contact means on said retainer for conducting electrical current;

said first and second electrical contact means being interengageable and disengageable with relative movement of said plunger with said retainer means;

said retainer means being axially shiftable in said switch housing to set said second electrical contact means in a selected location within said switch housing, said retainer means having holding means for holding said retainer means in the set location.

23. The switch in claim 22 wherein said holding means comprises locking means.

24. The switch in claim 23 wherein said locking means comprises a retaining ring having means for lockingly engaging said switch housing.

25. The switch in claim 24 wherein said engaging means comprises teeth.

26. The switch in claim 22 wherein said holding means allows movement in one direction but not in the return direction.

27. The switch in claim 25 wherein said teeth are oriented at an angle allowing said axial movement in one direction and not in the return direction.

28. The switch in claim 23 wherein said retainer means includes a retainer body with a close fit into said switch housing, and said locking means comprises a retainer ring engaged between said retainer body and said switch housing.

29. The switch in claim 22 wherein said switch housing has an opening at one end, and including biasing means in said switch housing operable for biasing said plunger in one axial direction toward said one end.

30. The switch in claim 29 wherein said holding means comprises locking means enabling said retainer means to be moved in axial direction opposite to said one axial direction but preventing said retainer means moving back in said one axial direction.

* * * * *

UNITED STATES PATENT AND TRADEMARK OFFICE

CERTIFICATE OF CORRECTION

PATENT NO. : 5,043,542

DATED : August 27, 1991

INVENTOR(S) : Mary J. McCombs et al.

It is certified that error appears in the above-identified patent and that said Letters Patent is hereby corrected as shown below:

Column 6, claim 1, line 29:
"on" should be --contraction--.

Column 7, claim 12, line 31:
After "open" insert --end ; --.

Signed and Sealed this

Thirteenth Day of July, 1993

*Attest:*

Michael K. Kirk

MICHAEL K. KIRK

*Attesting Officer*

*Acting Commissioner of Patents and Trademarks*